US010084264B1

(12) United States Patent
Zhou et al.

(10) Patent No.: US 10,084,264 B1
(45) Date of Patent: Sep. 25, 2018

(54) ELECTRICAL CONNECTOR CONFIGURED TO REDUCE RESONANCE

(71) Applicant: TE CONNECTIVITY CORPORATION, Berwyn, PA (US)

(72) Inventors: Xingling Zhou, Hummelstown, PA (US); Timothy Robert Minnick, Enola, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/584,964

(22) Filed: May 2, 2017

(51) Int. Cl.

| | |
|---|---|
| ***H01R 13/6461*** | (2011.01) |
| ***H01R 13/6598*** | (2011.01) |
| ***H01R 13/6586*** | (2011.01) |
| *H01R 13/514* | (2006.01) |
| *H01R 13/646* | (2011.01) |
| *H01R 13/6471* | (2011.01) |

(52) U.S. Cl.
CPC ..... *H01R 13/6461* (2013.01); *H01R 13/6586* (2013.01); *H01R 13/6598* (2013.01); *H01R 13/514* (2013.01); *H01R 13/646* (2013.01); *H01R 13/6471* (2013.01)

(58) Field of Classification Search
CPC ..... H01R 13/6461; H01R 13/6598; H01R 13/514; H01R 13/646; H01R 13/6471; H01R 13/6586
USPC ..... 439/607.05, 607.06, 607.07
See application file for complete search history.

(56) References Cited

U.S. PATENT DOCUMENTS

| | | | | |
|---|---|---|---|---|
| 8,182,289 | B2 * | 5/2012 | Stokoe | H01R 23/688 439/607.07 |
| 8,366,485 | B2 * | 2/2013 | Johnescu | H01R 13/514 439/108 |
| 8,556,657 | B1 * | 10/2013 | Nichols | H01R 13/6471 439/607.07 |
| 8,961,228 | B2 * | 2/2015 | Jeon | H01R 13/6463 439/607.07 |
| 2015/0056856 | A1 * | 2/2015 | Atkinson | H01R 13/6471 439/607.06 |
| 2016/0134057 | A1 * | 5/2016 | Buck | H01R 13/516 439/607.05 |
| 2016/0308309 | A1 * | 10/2016 | Stokoe | H01R 13/6586 |

* cited by examiner

*Primary Examiner* — Tulsidas C Patel
*Assistant Examiner* — Travis Chambers

(57) ABSTRACT

Electrical connector includes a connector body having a front side configured to engage a first electrical component and a mounting side configured to engage a second electrical component. The electrical connector also includes a plurality of signal conductors extending through the connector body. The signal conductors include mating interfaces and mounting interfaces that are positioned for engaging the first and second electrical components, respectively. The electrical connector also includes a ground structure extending generally parallel to and between two of the signal conductors. The connector body has a resonance-control surface that faces the ground structure. The resonance-control surface is shaped to include alternating distal and proximal areas. The proximal areas are closer to the ground structure than the distal areas.

20 Claims, 7 Drawing Sheets

ELECTRICAL CONNECTOR CONFIGURED TO REDUCE RESONANCE

BACKGROUND

The subject matter herein relates generally to electrical connectors that have signal conductors configured to convey data signals and ground structures that provide a ground return path, reduce crosstalk between the signal conductors, and/or control impedance.

Communication systems exist today that utilize electrical connectors to transmit data. For example, network systems, servers, data centers, and the like may use numerous electrical connectors to interconnect the various devices of the communication system. Many electrical connectors include signal conductors and ground structures that are positioned between the signal conductors. The ground structures provide return current paths, mitigate crosstalk between the signal conductors, and control impedance. Examples of such ground structures include elongated ground conductors and ground shields.

As one example, a known communication system includes electrical connectors mounted to daughter cards that are configured to engage header connectors mounted to a backplane. The electrical connector includes a plurality of contact modules that are stacked side-by-side. Each contact module includes signal conductors, ground conductors, and at least one ground shield. The signal conductors are arranged in signal pairs and the ground conductors are positioned between adjacent signal pairs. The signal and ground conductors may be arranged in a ground-signal-signal-ground (GSSG) pattern such that the signal and ground conductors are aligned in a common plane. The ground shield electrically shields the signal and ground conductors of one contact module from the signal and ground conductors of another conductor. The ground shield also provides a return path and controls impedance of the electrical connector.

As another example, a known input/output (I/O) connector is configured to receive a pluggable small-form factor (SFF) module. The I/O connector includes a connector housing that forms a slot for receiving a circuit board from the pluggable SFF module. The I/O connector includes one or more rows of conductors in which each conductor engages a corresponding contact pad of the circuit board. The conductors include signal and ground conductors and may be arranged in a ground-signal-signal-ground (GSSG) pattern for each row.

There has been a general demand to increase the density of signal conductors within the electrical connectors and/or increase the speeds at which data is transmitted through the electrical connectors. As data rates increase and/or distances between the signal pairs decrease, however, it becomes more challenging to maintain a baseline level of signal quality. For example, the ground structures (e.g., the ground conductors and/or ground shields) may form surface waves that propagate between different points of the ground structures. The surface waves may be repeatedly reflected and form a resonating condition (or standing wave) that causes electrical noise. Depending on the frequency of the data transmission, the electrical noise may increase return loss and/or crosstalk and reduce throughput of the electrical connector.

Although techniques for dampening electrical resonance exist, the effectiveness and/or cost of implementing these techniques is based on a number of variables, such as the geometries of the connector housing, the signal and ground conductors, and the ground shields. For some applications and/or electrical connector configurations, alternative methods for controlling resonance along the ground structures may be desired.

Accordingly, there is a need for electrical connectors that reduce the electrical noise caused by resonating conditions in ground structures.

BRIEF DESCRIPTION

In an embodiment, an electrical connector is provided that includes a connector body having a front side configured to engage a first electrical component and a mounting side configured to engage a second electrical component. The electrical connector also includes a plurality of signal conductors extending through the connector body. The signal conductors include mating interfaces and mounting interfaces that are positioned for engaging the first and second electrical components, respectively. The electrical connector also includes a ground structure extending generally parallel to and between two of the signal conductors. The connector body has a resonance-control surface that faces the ground structure. The resonance-control surface is shaped to include alternating distal and proximal areas. The proximal areas are closer to the ground structure than the distal areas.

In some aspects, the connector body includes a molded dielectric body having the resonance-control surface. Optionally, the ground structure is an elongated ground conductor and is coplanar with the signal conductors. Also optionally, the ground structure is a ground shield having a broad side that faces the distal and proximal areas of the resonance-control surface. The proximal areas and the distal areas may define a recess along the resonance-control surface. The broad side may abut two of the proximal areas and cover an opening to the recess between the two proximal areas.

In some aspects, the proximal areas and the distal areas define a recess along the resonance-control surface. The recess extends across at least two of the signal conductors. Optionally, for at least portions of the at least two signal conductors, the at least two signal conductors extend parallel to one another and an axis. The recess may extend lengthwise perpendicular to the axis.

In some aspects, the signal conductors form at least four signal pairs configured for differential signal transmission. The ground structure includes a plurality of ground shields. Each of the ground shields is positioned between at least two of the signal pairs. At least two of the signal pairs are positioned between adjacent ground shields. The mating interfaces of the signal conductors form a two-dimensional array for engaging the first electrical component at the front side.

In some aspects, the electrical connector is a pluggable input/output (I/O) connector in which the ground structure and the signal conductors are elongated conductors.

In some aspects, the alternating distal and proximal areas are designed to cause reflections within surface waves of electrical energy that propagates along the ground structure.

In some aspects, the signal conductors form a plurality of signal pairs configured for differential signal transmission.

In an embodiment, an electrical connector is provided that includes a connector body having a front side configured to engage a first electrical component and a mounting side configured to engage a second electrical component. The connector body includes a plurality of dielectric sections. The electrical connector also includes a plurality of signal conductors extending through or along respective dielectric sections. The signal conductors include mating interfaces and mounting interfaces that are positioned for engaging the first and second electrical components, respectively. The signal conductors form signal pairs in which a plurality of the signal pairs are positioned between adjacent ground shields. The electrical connector also includes a plurality of ground shields interleaved between adjacent dielectric sections. Each of the dielectric sections has a resonance-control surface extending along a broad side of one of the ground shields. The resonance-control surface are shaped to include alternating distal and proximal areas that face the broad side. The proximal areas are closer to the ground structure than the distal areas.

In some aspects, the ground shields are shaped to attach to corresponding dielectric sections of the plurality of dielectric sections to form contact modules. The contact modules are stacked side-by-side.

In some aspects, each of the dielectric sections includes a plurality of the resonance-control surfaces. The proximal areas and the distal areas of each of the dielectric sections form a plurality of recesses that are covered by a common ground shield of the plurality of ground shields.

In some aspects, the proximal areas and the distal areas define a recess along the resonance-control surface that extends across at least two signal conductors. For at least portions of the at least two signal conductors, the at least two signal conductors extend parallel to one another and an axis and the recess extends lengthwise perpendicular to the axis.

In some aspects, the mating interfaces of the signal conductors are arranged in a high-density two-dimensional array for engaging the first electrical component. The electrical connector is designed for backplane or midplane communication systems and designed to operate at data rates greater than 10 gigabits/second (Gbps).

In some aspects, the alternating distal and proximal areas are designed to cause reflections within surface waves of electrical energy that propagates along the ground structure.

In an embodiment, an electrical connector is provided that includes a connector body having a front side configured to engage a first electrical component and a mounting side configured to engage a second electrical component. The connector body includes a plurality of dielectric sections. The electrical connector also includes a plurality of signal conductors extending through or along respective dielectric sections. The signal conductors include mating interfaces and mounting interfaces that are positioned for engaging the first and second electrical components, respectively. The signal conductors form signal pairs. The electrical connector also includes a plurality of ground shields interleaved between adjacent dielectric sections. A plurality of the signal pairs are positioned between adjacent ground shields, wherein each of the dielectric sections has a section side that abuts a broad side of a respective ground shield of the plurality of ground shields. The section side is shaped to include a plurality of recesses that open to the broad side.

In some aspects, the signal conductors form at least ten signal pairs. Each of the ground shields is positioned between at least two of the signal pairs. At least two of the signal pairs are positioned between adjacent ground shields. The mating interfaces of the signal conductors form a high-density two-dimensional array for engaging the first electrical component. Optionally, the electrical connector is designed to operate at data rates greater than 10 gigabits/second (Gbps). The recesses are designed to cause reflections within surface waves of electrical energy that propagates along the ground shields.

DETAILED DESCRIPTION

Figure 1:
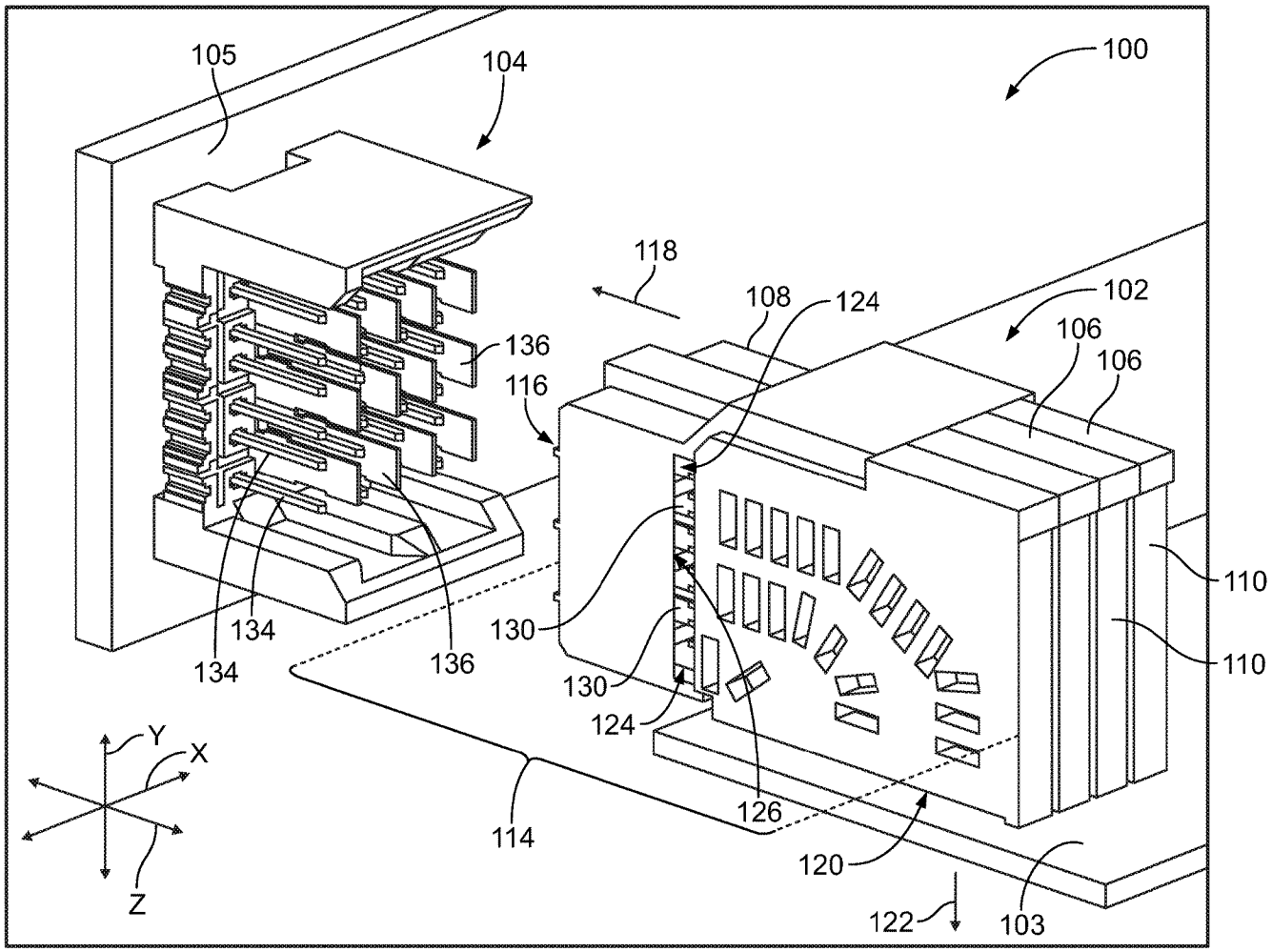
FIG. 1 is a perspective view of a communication system that includes an electrical connector formed in accordance with an embodiment.

Embodiments set forth herein include electrical connectors having signal conductors configured to convey data signals and ground structures that provide a ground return path, reduce crosstalk between the signal conductors, and/or control impedance. The ground structures may include, for example, ground shields that are positioned between adjacent signal conductors and/or elongated ground conductors (e.g., stamped and formed contacts) that are positioned between adjacent signal conductors. Embodiments may be configured to improve electrical performance by dampening or impeding the development of electrical resonance that may occur along the ground structures.

To reduce the unwanted effects of electrical resonance, embodiments described herein include resonance-control surfaces that are shaped to include a plurality of proximal areas and a plurality of distal areas. A proximal area is a local area of the resonance-control surface that abuts the ground structure. As set forth herein, a local area of the resonance-control surface may "abut" the ground structure if a nominal gap exists between the local area and the ground structure, if the local area is part of a discrete structure that presses against the ground structure, or if the local area is defined by material that encases (e.g., through molding) the ground structure. A distal area is a local area of the resonance-control surface that is positioned further away from the ground structure than an adjoining proximal area. In other words, the proximal area of the resonance-control surface is closer to the ground structure than the adjoining distal area. The proximal areas and the distal areas are arranged in series and in an alternating manner such that each of the distal areas may extend between adjacent proximal areas and each of the proximal areas may extend between adjacent distal areas. The alternating proximal and distal areas define a series of recesses that open to the ground structure.

The series of proximal and distal areas change a distance between the ground structure and the resonance-control surface. The series of proximal and distal areas may change a surface wave of electrical energy that propagates between different points of the ground structure. Without being bound to a particular theory, the series of proximal and distal areas (or the series of recesses along the ground structure) may cause fluctuations in the impedance experienced by the surface wave. These fluctuations may cause reflections in the surface wave that destructively interfere with one another to dampen the surface wave. Particular embodiments may reduce the likelihood that electrical noise generated by one ground structure may couple to and affect an adjacent ground structure.

A shape of the resonance-control surface may be selected to achieve a target performance. More specifically, dimensions of the proximal areas, dimensions of the distal areas, dimensions of the recesses, and/or depths of the recesses may be selected to achieve a target performance. As such, the recesses may be positioned in a regular or irregular pattern. In some embodiments, the recesses have a cubed or parallelepiped volume. Yet in other embodiments, the recesses may be rounded or wave-like.

In some embodiments, the electrical connectors are configured to mate with other electrical connectors during a mating operation. During the mating operation, a first conductor of one connector may engage and slide (or wipe) along a second conductor of the other connector. The first and second conductors may engage each other at mating zones. The mating zones typically have smooth surfaces to create a sufficient number of contact points between the first and second conductors. The first and second conductors may be signal conductors or ground conductors.

Although the illustrated embodiment includes electrical connectors that are used in high-speed communication systems, such as backplane or midplane communication systems or input/output (I/O) systems, it should be understood that embodiments may be used in other communication systems or in other systems/devices that utilize ground structures. Accordingly, the inventive subject matter is not limited to the illustrated embodiments.

For example, the electrical connectors shown in the drawings have a front side that is configured to mate with another connector and a mounting side that is configured to be mounted to a printed circuit board. It should be understood, however, that electrical connectors set forth herein may be configured to interconnect a different combination of electrical components (e.g., other electrical connectors, circuit boards, or other components having conductive pathways). For instance, in some embodiments, the electrical connector may have a front side that is configured to mate with a first electrical component and a mounting side that is configured to mate with a second electrical component. Alternatively, the front side may be configured to mate with the second electrical component or the mounting side may be configured to mate with the second electrical component.

Embodiments may be particularly suitable for communication systems, such as network systems, servers, data centers, and the like, in which the data rates may be greater than ten (10) gigabits/second (Gbps) or greater than five (5) gigahertz (GHz). One or more embodiments may be configured to transmit data at a rate of at least 20 Gbps, at least 40 Gbps, at least 56 Gbps, or more. One or more embodiments may be configured to transmit data at a frequency of at least 10 GHz, at least 20 GHz, at least 28 GHz, or more. It is contemplated, however, that other embodiments may be configured to operate at data rates that are less than 10 Gbps or operate at frequencies that are less than 5 GHz.

As used herein with respect to data transfer, the term "configured to" does not mean mere capability in a hypothetical or theoretical sense, but means that the embodiment is designed to transmit data at the designated rate or frequency for an extended period of time (e.g., expected time periods for commercial use) and at a signal quality that is sufficient for its intended commercial use. The phrase "designed to" may be replaced by "configured to" and vice versa.

Various embodiments may be configured for certain applications. One or more embodiments may be configured for backplane or midplane communication systems. For example, one or more of the electrical connectors described herein may be similar to electrical connectors of the STRADA Whisper or Z-PACK TinMan product lines developed by TE Connectivity. The electrical connectors may include high-density arrays of electrical contacts. A high-density array may have, for example, at least 12 signal contacts per 100 $mm^2$ along the front side or the mounting side of the electrical connector. In more particular embodiments, the high-density array may have at least 20 signal contacts per 100 $mm^2$.

Non-limiting examples of some applications that may use embodiments set forth herein include host bus adapters (HBAs), redundant arrays of inexpensive disks (RAIDs), workstations, servers, storage racks, high performance computers, or switches. Embodiments may also include electrical connectors that are pluggable input/output (I/O) connectors. For example, the electrical connectors may be configured to be compliant with certain standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard.

As used herein, phrases such as "a plurality of [elements]" and "an array of [elements]" and the like, when used in the detailed description and claims, do not necessarily include each and every element that a component may have. The component may have other elements that are similar to the plurality of elements. For example, the phrase "a plurality of dielectric sections [being/having a recited feature]" does not necessarily mean that each and every dielectric section of the component has the recited feature. Other dielectric sections may not include the recited feature. Accordingly, unless explicitly stated otherwise (e.g., "each and every dielectric section of the electrical connector [being/having a recited feature]"), embodiments may include similar elements that do not have the recited features.

In order to distinguish similar elements in the detailed description and claims, various labels may be used. For example, an electrical connector may be referred to as a header connector, an electrical connector, or a mating connector. Electrical contacts may be referred to as header contacts, receptacle contacts, or mating contacts. When similar elements are labeled differently (e.g., receptacle contacts and mating contacts), the different labels do not necessarily require structural differences.

FIG. 1 is a perspective view of a partially assembled communication system 100. The communication system 100 includes an electrical connector 102 and a first electrical component 104. For reference, the communication system 100 is oriented with respect to mutually perpendicular X, Y, and Z axes. In some embodiments, the electrical connector 102 and the first electrical component 104 are a receptacle connector and a header connector, respectively, and the communication system 100 is a backplane communication system. For example, the electrical connector 102 may be similar to receptacle connectors of the Z-PACK TinMan product lines developed by TE Connectivity. The electrical connector 102 is mounted to a second electrical component 103 (e.g., a daughter card) and the first electrical component 104 is mounted to a backplane circuit board 105.

In other embodiments, the communication system 100 may be a midplane communication system. Embodiments, however, are not limited to backplane or midplane communication systems and may be suitable for other applications. For example, one or more embodiments may be a pluggable I/O connector. Embodiments may be designed to engage different types of electrical components. For example, an electrical component may be another electrical connector (or mating connector) or may be a printed circuit. The first electrical component 104 is hereinafter referred to as the mating connector 104, and the second electrical component 103 is hereinafter referred to as the printed circuit (or circuit board) 103.

In the illustrated embodiment, the electrical connector 102 includes a plurality of discrete contact modules 106 and a front housing 108 that is coupled to the plurality of contact modules 106. Each of the contact modules 106 includes a dielectric section or body 110 and at least one ground structure 112 (shown in FIG. 3). The ground structures 112 may be interleaved between the dielectric sections 110 of adjacent contact modules 106. The contact modules 106 are stacked side-by-side. The contact modules 106 and the front housing 108 collectively form a connector body 114 of the electrical connector 102.

The connector body 114 has a front side 116 that faces in a mating direction 118 along the Z axis. The front side 116 defines the front or forward-most portion of the electrical connector 102. In the illustrated embodiment, the front housing 108 includes the front side 116 of the connector body 114. The connector body 114 also has a mounting side 120 that faces in a mounting direction 122 along the Y axis. In the illustrated embodiment, the contact modules 106 collectively define the mounting side 120. The front side 116 is configured to engage the mating connector 104, and the mounting side 120 is configured to engage the printed circuit 103. In alternative embodiments, the mounting side 120 may face in a mounting direction along the X axis or in a mounting direction along the Z axis that is opposite the mating direction 118.

The front housing 108 has passages 124 that extend between the front side 116 and a loading side 126 of the front housing 108. The loading side 126 engages the contact modules 106. The passages 124 align with and are configured to receive signal conductors 130 and ground extensions 132 (shown in FIG. 3) from corresponding contact modules 106. The passages 124 are also configured to receive signal contacts 134 and ground contacts 136 of the mating connector 104. In the illustrated embodiment, the signal contacts 134 are signal pins and the ground contacts 136 are ground walls or shields.

Figure 2:
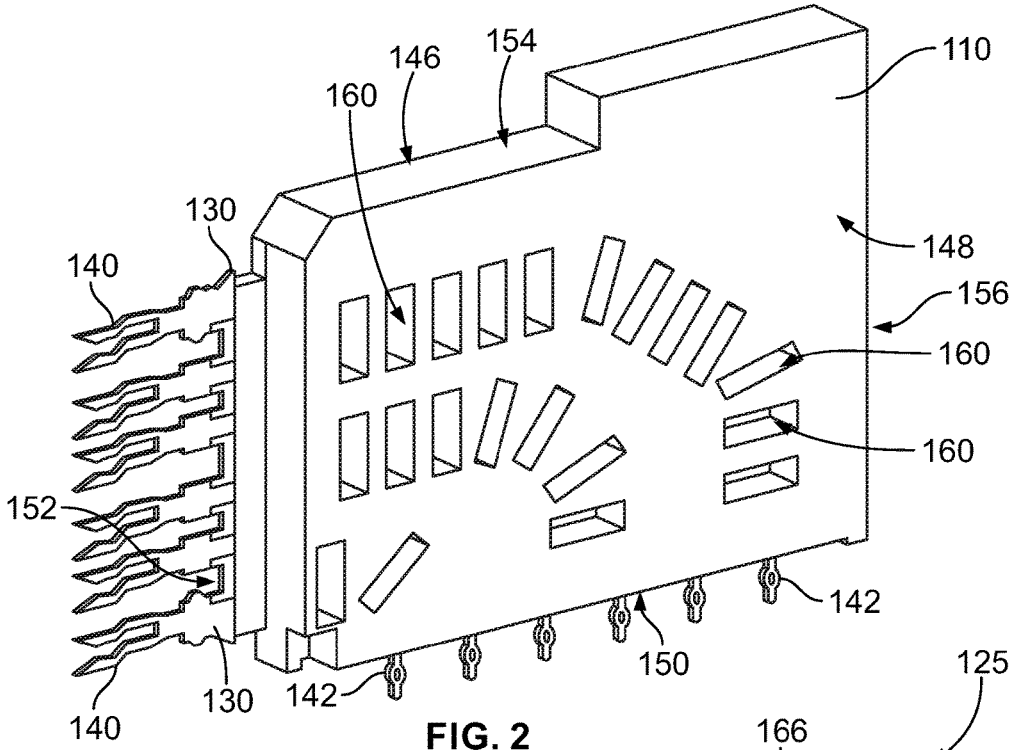
FIG. 2 is a perspective view of overmolded signal conductors that may be used with the electrical connector of FIG. 1.

FIG. 2 is a perspective view of the dielectric section 110 of a contact module 106 (shown in FIG. 1). In the illustrated embodiment, the dielectric section 110 is a molded dielectric body in which the dielectric material that is molded around the signal conductors 130. The signal conductors 130 extend through the dielectric section 110. Each of the signal conductors 130 includes a mating interface 140 and mounting interface 142 that are configured to be positioned along the front side 116 (FIG. 1) and the mounting side 120 (FIG. 1), respectively, of the connector body 114 (FIG. 1). The mating interfaces 140 are configured to engage the signal contacts 134 (FIG. 1), and the mounting interfaces 142 are configured to engage the printed circuit 103 (FIG. 1).

The signal conductors 130 may be formed from a common lead frame (not shown) that is stamped from conductive sheet material. The conductive sheet material may include one or more metal layers. For example, a base layer of the stamped sheet material may be a phosphor bronze, beryllium copper, brass, or other metal material. The stamped sheet material may be plated with one or more other metal materials. For instance, a diffusion layer may be plated over the base layer and may comprise, for example, nickel and/or tin. The diffusion layer may be plated with one or more other metal materials, such as a precious metal (e.g., gold).

As part of the lead frame, the signal conductors 130 may be interconnected through bridges (not shown). After the dielectric section 110 is molded around the lead frame, the bridges may be broken to electrically separate the signal conductors 130. However, other methods of manufacturing the dielectric section 110 exist. For example, in other embodiments, the signal conductors 130 may be sandwiched between two dielectric sub-sections. Yet in other embodiments, the ground shields 125 (FIG. 3) or other ground structures may form part of the lead frame.

The dielectric section 110 has opposite section sides 146, 148. The dielectric section 110 also includes a mounting edge 150, a front or mating edge 152, a body edge 154, and a rear edge 156. The mounting edges 150 of the contact modules 106 (FIG. 1) collectively form the mounting side 120 (FIG. 1).

Also shown in FIG. 2, the section side 148 includes a plurality of recesses 160. The recesses 160 open to the section side 148 and are positioned along respective signal paths 135 (shown in FIG. 6). In the illustrated embodiment, the recesses 160 extend only partially between the section sides 146, 148. As described herein, the recesses 160 are designed and positioned to achieve a target electrical performance.

Figure 3:
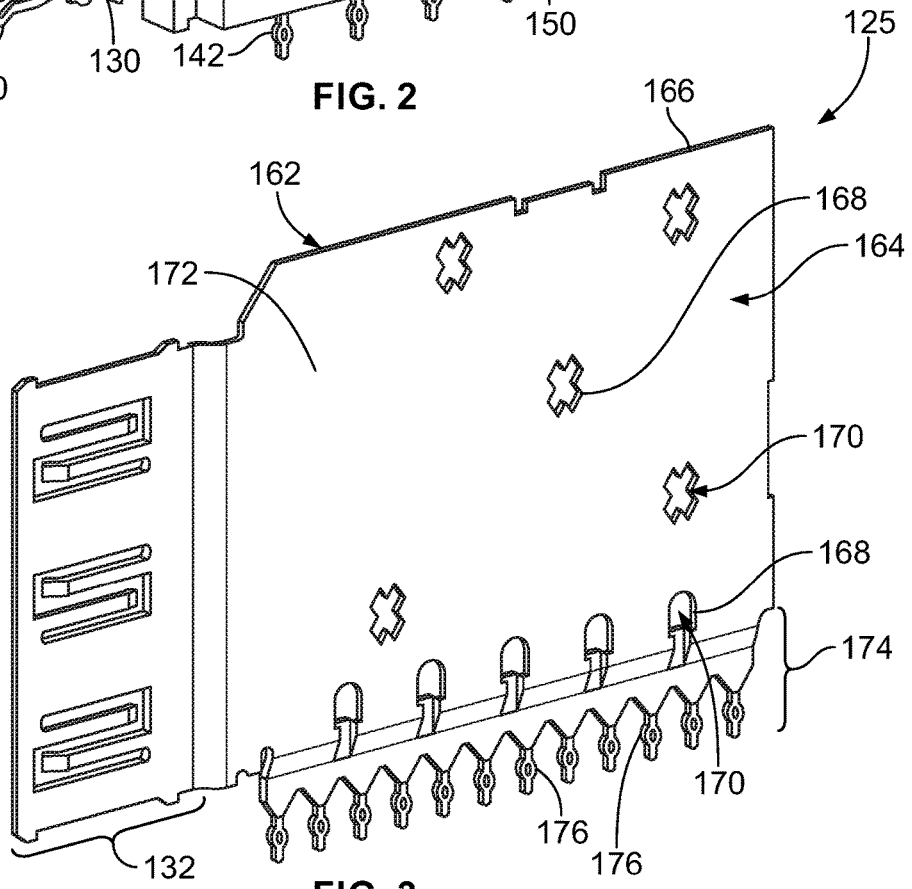
FIG. 3 is a perspective of a ground structure that may be used with the electrical connector of FIG. 1.

FIG. 3 is an isolated perspective view of the ground shield 125. The ground shield 125 may be stamped-and-formed from conductive sheet material. The ground shield 125 has opposite broad sides 162, 164 and an outer shield edge 166 that defines a profile or perimeter of the ground shield 125. Optionally, the ground shield 125 may include a plurality of inner shield edges 168 that define openings 170 through the ground shield 125.

The ground shield 125 is configured to be positioned between adjacent dielectric sections 110 (FIG. 1) and may include a plurality of shield sections that are coupled to one another. For example, the ground shield 125 includes a body section 172, the ground extension 132, and a mounting section 174. The body section 172 is configured to be positioned between the adjacent dielectric sections 110. The ground extension 132 is configured to electrically shield the mating interfaces 140 (FIG. 2) of the signal conductors 130 (FIG. 1) from the mating interfaces 140 of an adjacent contact module 106 (FIG. 1). The mounting section 174 is configured to be mechanically and electrically coupled to the printed circuit 103 (FIG. 1). For example, the mounting section 174 may include mounting interfaces 176 that are designed to be inserted into corresponding plated thru-holes (PTHs) of the printed circuit 103.

Figure 4:
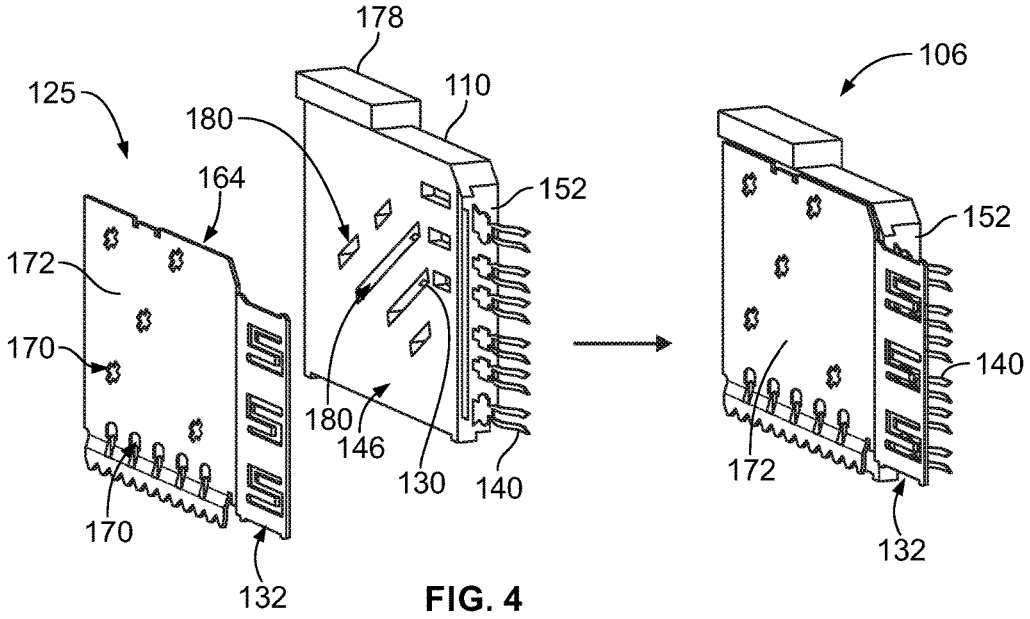
FIG. 4 illustrates how the overmolded signal conductors and the ground structure may be combined to form a contact module of the electrical connector of FIG. 1.

FIG. 4 illustrates how a contact module 106 of the electrical connector 102 (FIG. 1) is formed. As shown, the section side 146 of the dielectric section 110 includes a plurality of channels or openings 180. The channels 180 expose portions of the signal conductors 130 to air and are designed to achieve a target electrical performance of the electrical connector 102 (FIG. 1). Also shown, the dielectric section 110 may include an overhanging portion 178 that projects laterally beyond the section side 146.

To assemble the contact module 106, the broad side 164 of the ground shield 125 may be positioned to abut the section side 146 of the dielectric section 110. The shield edge 166 may engage the overhanging portion 178. The overhanging portion 178 may clear the section side 146 by at least a thickness of the ground shield 125. The body section 172 is sized and shaped to cover essentially an entirety of the section side 146. The ground extension 132 clears the front edge 152 of the dielectric section 110 and is positioned along the mating interfaces 140. Optionally, the dielectric section 110 may engage portions of the ground shield 125. For example, one or more of the openings 170 may receive a portion of the dielectric section 110 and form an interference fit therewith.

Figure 5:
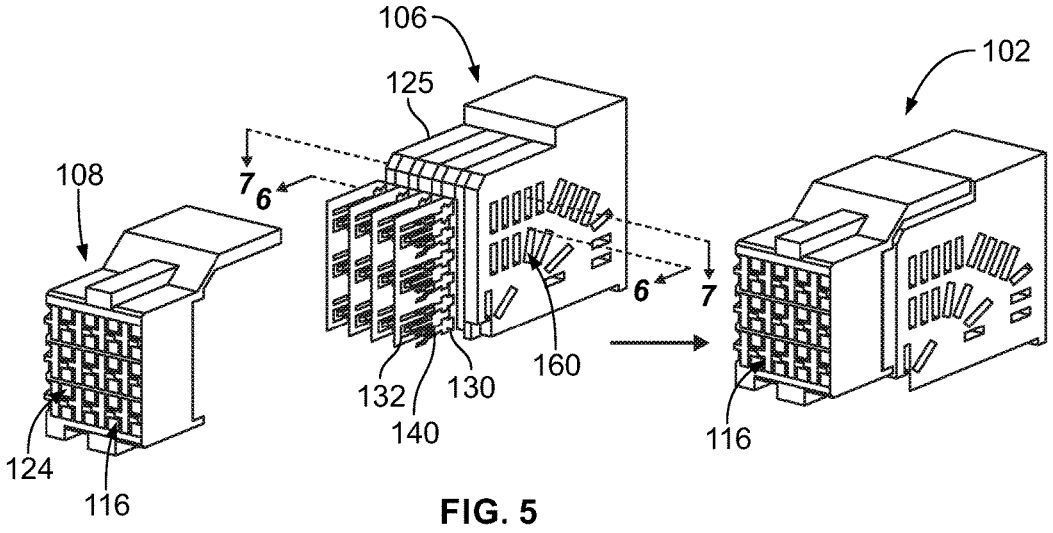
FIG. 5 illustrates how the electrical connector of FIG. 1 may be assembled from a plurality of the contact modules and a front housing.

FIG. 5 illustrates how the electrical connector 102 may be assembled from a plurality of the contact modules 106 and a front housing 108. The contact modules 106 are stacked side-by-side. In the illustrated embodiment, the ground shield 125 of one contact module 106 is configured to cover the recesses 160 of the adjacent contact module 106. In other embodiments, however, the ground shield 125 of a contact module 106 may cover the recesses 160 of the same contact module 106.

The passages 124 of the front housing 108 are sized and shaped to receive the mating interfaces 140 of the signal conductors 130 and the ground extensions 132 of the ground shields 125. After assembly, the mating interfaces 140 and the ground extensions 132 are disposed entirely within the front housing 108 such that the signal contacts 134 (FIG. 1) and the ground contacts 136 (FIG. 1) engage the mating interfaces 140 and the ground extensions 132, respectively, within the front housing 108. In alternative embodiments, the mating interfaces 140 and the ground extensions 132 may clear the front side 116.

Figure 6:
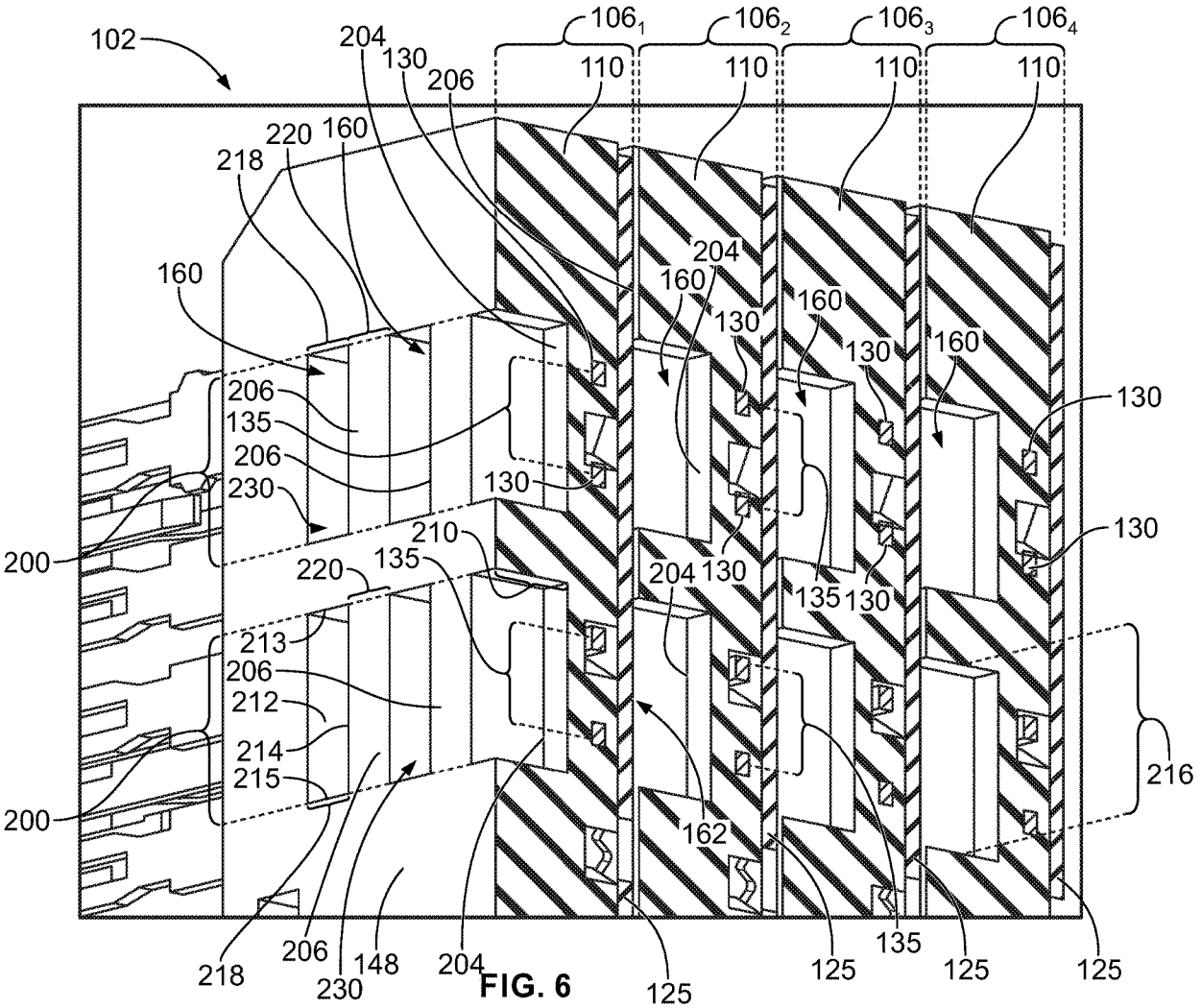
FIG. 6 is a sectional view of a portion of the electrical connector taken along the line 6-6 in FIG. 5.
Figure 7:
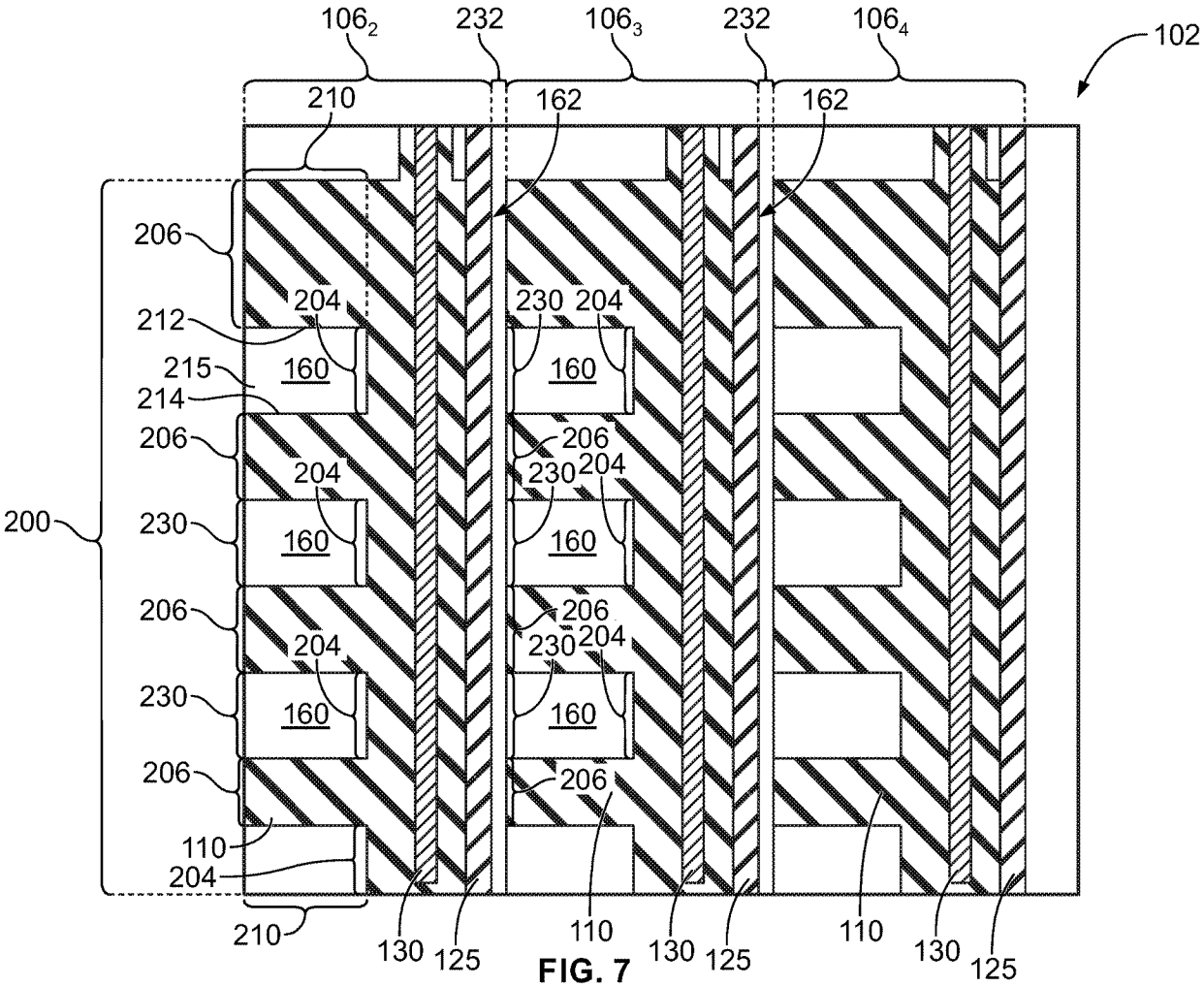
FIG. 7 is a cross-section of a portion of the electrical connector taken along the line 7-7 in FIG. 5.

FIG. 6 is a sectional view of a portion of the electrical connector 102 taken along the line 6-6 in FIG. 5. FIG. 7 is a cross-section of a portion of the electrical connector 102 taken along the line 7-7 in FIG. 5. FIG. 6 includes four contact modules $\mathbf{106}_1$, $\mathbf{106}_2$, $\mathbf{106}_3$, and $\mathbf{106}_4$. FIG. 7 shows the contact modules $\mathbf{106}_2$, $\mathbf{106}_3$, and $\mathbf{106}_4$. Each of the contact modules $\mathbf{106}_1$, $\mathbf{106}_2$, $\mathbf{106}_3$, and $\mathbf{106}_4$ includes a ground shield 125, a dielectric section 110 having recesses 160, and a plurality of signal conductors 130. The recesses 160 have openings 230 that open to the corresponding section side 148. The ground shields 125 are interleaved between adjacent dielectric sections 110.

As shown in FIG. 6, the signal conductors 130 are arranged in signal pairs 135. The signal conductors 130 of a single signal pair 135 have essentially identical paths through the dielectric section 110. The signal pairs 135 are configured for differential signal transmission and, as such, may be referred to as differential pairs.

Also shown in FIG. 6, each of the ground shields 125 is positioned between signal conductors 130. For example, the ground shield 125 of the contact module $\mathbf{106}_1$ is positioned between the signal conductors 130 of the contact module $\mathbf{106}_1$ and the signal conductors 130 of the contact module $\mathbf{106}_2$. More specifically, the ground shield 125 of the contact module $\mathbf{106}_1$ is positioned between signal pairs 135 of the contact module $\mathbf{106}_1$ and signal pairs 135 of the contact module $\mathbf{106}_2$. Moreover, a plurality of signal conductors 130 are positioned between two adjacent ground shields 125. Multiple signal pairs 135 of the contact module $\mathbf{106}_2$ are positioned between the ground shield 125 of the contact module $\mathbf{106}_1$ and the ground shield 125 of the contact module $\mathbf{106}_2$. In the illustrated embodiment, the signal conductors 130 of the contact module $\mathbf{106}_2$ are closer to the ground shield 125 of the contact module $\mathbf{106}_2$ than the ground shield 125 of the contact module $\mathbf{106}_1$.

With respect to FIGS. 6 and 7, each of the dielectric sections 110 has one or more resonance-control surfaces 200. The resonance-control surfaces 200 have non-planar contours (e.g., corrugated or wavy contours). When the electrical connector 102 (FIG. 1) is fully assembled, the resonance-control surfaces 200 are positioned to extend along the broad side 162 of one of the ground shields 125. In FIG. 6, a ground shield 125 is not shown along the section side 148 of the dielectric section 110 of the contact module $\mathbf{106}_1$. It should be understood, however, that a ground shield 125 may be positioned along the section side 148 and cover recesses 160 of the dielectric section 110 of the contact module $\mathbf{106}_1$ when the electrical connector 102 is fully assembled.

Each of the resonance-control surfaces 200 is shaped to impede the development of electrical resonance that may occur along the ground shields 125. In certain embodiments, the resonance-control surface 200 may dampen electrical noise generated by one ground shield 125 and reduce coupling of the electrical noise with an adjacent ground shield 125.

Each of the resonance-control surfaces 200 is shaped to include distal areas 204 and proximal areas 206 that face the broad side 162 of one of the ground shields 125. For example, the dielectric section 110 may be molded to include the distal and proximal areas 204, 206. Alternatively, the dielectric section 110 may be provided and portions of the dielectric section 110 may be removed to form the resonance-control surface 200. The proximal areas 206 are closer to the broad side 162 of the ground shield 125 than the distal areas 204. The distal areas 204 and the proximal areas 206 alternate such that a distal area 204 extends between adjacent proximal areas 206 of the resonance-control surface 200.

Dimensions of the distal areas 204, the proximal areas 206, and the recesses 160 may be selected to achieve a target performance of the electrical connector 102 (FIG. 1). For example, the distal area 204 is located a depth 210 away from the adjacent proximal areas 206. The distal areas 204 and the proximal areas 206 form the recesses 160. Each of the recesses 160 is defined by the distal area 204 and respective interior surfaces 212, 213 (shown in FIG. 6), 214, and 215. The interior surfaces 212-215 extend the depth 210 between the distal area 204 and the proximal areas 206. In the illustrated embodiment, the interior surfaces 212-215 are planar surfaces that are perpendicular to the distal area 204 and the proximal areas 206. In other embodiments, however, the interior surfaces 212-215 may have a non-planar shape and/or may be non-orthogonal with respect to the distal area 204 and the proximal areas 206. Other dimensions that may be selected to achieve the target performance include a length 216 of the recesses 160, a width 218 of the recesses 160, and a separation distance 220 between adjacent recesses 160.

Turning to FIG. 7, the ground shields 125 are configured to cover the openings 230 of the recesses 160 and abut the proximal areas 206. As shown, a small gap 232 exists between the proximal areas 206 and the ground shield 125. The gap 232 may be determined by the size and shape of the overhanging portion 178 (FIG. 4).

Figure 8:
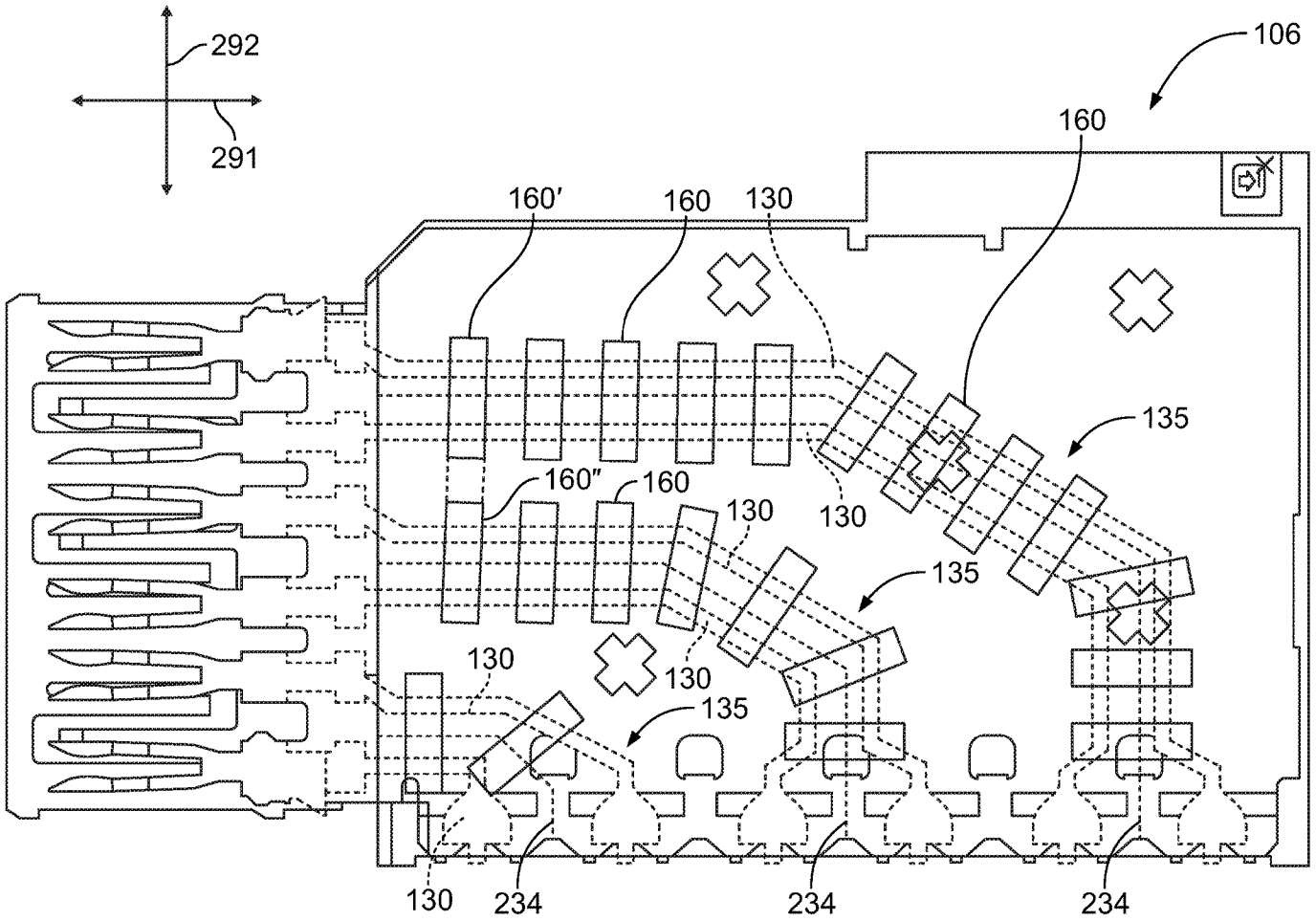
FIG. 8 illustrates an arrangement of signal conductors of the electrical connector of FIG. 1 relative to recesses of a dielectric section.

FIG. 8 is a side view of one of the contact modules 106. The signal conductors 130 and signal pairs 135 are shown in phantom. Each of the signal pairs 135 extends along a signal path 234, which is represented by a center line extending between the two signal conductors 130 of the signal pair 135. The recesses 160 may be oriented orthogonal to the signal paths 234. For example, FIG. 8 shows a first axis (or signal axis) 291 and a second axis (or elevation axis) 292 that is perpendicular to the first axis 291. Each of the signal paths 234 extends parallel to the first axis 291 for a portion of the signal path 234. The recesses 160, however, extend lengthwise in a direction along the second axis 292 or in a direction that is perpendicular to the first axis 291.

In some embodiments, the recesses 160 extend across at least two of the signal conductors 130. For example, each of the recesses 160 extends across the two signal conductors of a signal pair 135. Optionally, a single recess 160 may extend across more than two signal conductors 130. For example, the recesses 160' and 160" may form a single recess that extends across four signal conductors.

Figure 9:
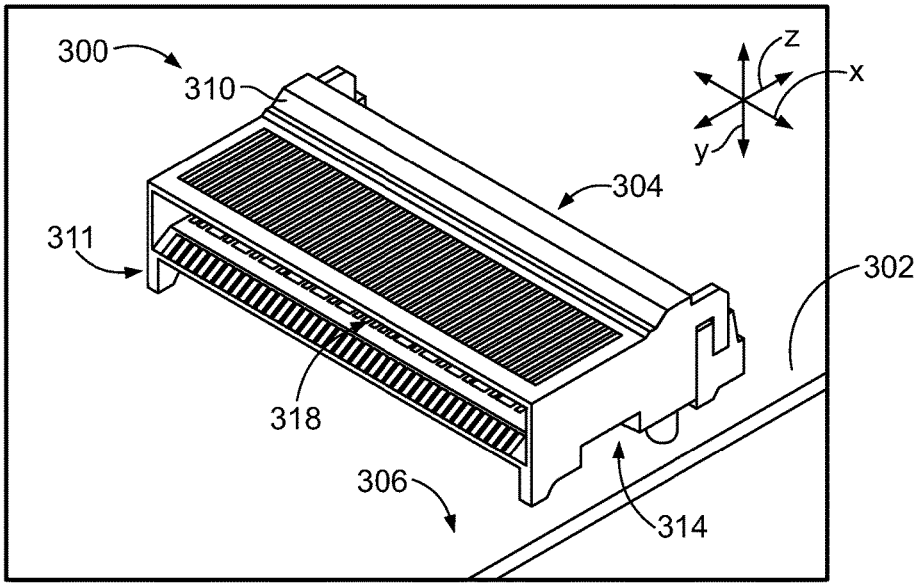
FIG. 9 is a perspective view of a portion of a circuit board assembly that includes an electrical connector formed in accordance with an embodiment.

FIG. 9 is a perspective view of a portion of a circuit board assembly 300 formed in accordance with an embodiment. The circuit board assembly 300 includes a circuit board 302 and an electrical connector 304 that is mounted onto a board surface 306 of the circuit board 302. The circuit board assembly 300 is oriented with respect to mutually perpendicular X, Y, and Z axes.

In some embodiments, the circuit board assembly 300 may be a daughter card assembly that is configured to engage a backplane or midplane communication system (not shown). In other embodiments, the circuit board assembly 300 may include a plurality of the electrical connectors 304 mounted to the circuit board 302 along an edge of the circuit board 302 in which each of the electrical connectors 304 is configured to engage a corresponding pluggable input/output (I/O) connector. The electrical connectors 304 and pluggable I/O connectors may be configured to satisfy certain industry standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard. In some embodiments, the pluggable I/O connector may be configured to be compliant with a small form factor (SFF) specification, such as SFF-8644 and SFF-8449 HD. In some embodiments, the electrical connectors 304 described herein may be high-speed electrical connectors.

Although not shown, each of the electrical connectors 304 may be positioned within a receptacle cage. The receptacle cage may be configured to receive one of the pluggable I/O connectors during a mating operation and direct the pluggable I/O connector toward the corresponding electrical connector 304. The circuit board assembly 300 may also include other devices that are communicatively coupled to the electrical connectors 304 through the circuit board 302. The electrical connectors 304 may be positioned proximate to one edge of the circuit board.

The electrical connector 304 includes a connector body 310 having a plurality of sides. The sides include a front side 311 and a mounting side 314. The front side 311 is configured to engage an electrical component (not shown), such as a pluggable transceiver, and the mounting side 314 is mounted to the board surface 306. In the illustrated embodiment of FIG. 9, the electrical connector 304 is a right-angle connector such that the front side 311 and the mounting side 314 are oriented substantially perpendicular or orthogonal to each other. In other embodiments, the front side 311 and the mounting side 314 may face in different directions than those shown in FIG. 9. For example, the front side 311 and the mounting side 314 may face in opposite directions.

The connector body 310 includes a receiving cavity 318 that is sized and shaped to receive a portion of the other connector. For example, in the illustrated embodiment, the receiving cavity 318 is sized and shaped to receive a circuit board (not shown) of the other connector. The circuit board of the other connector may include one or more rows of contact pads (not shown) located along a leading edge of the circuit board.

Figure 10:
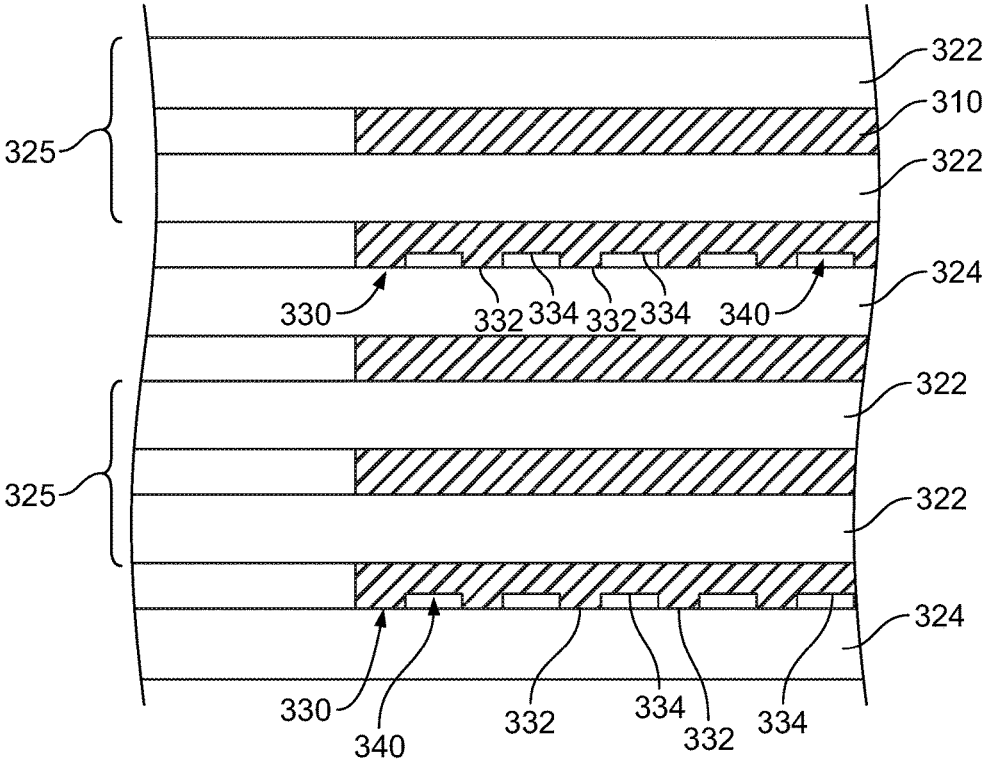
FIG. 10 illustrates a plurality of signal and ground conductors that may be used with the electrical connector of FIG. 9.

FIG. 10 illustrates signal conductors 322 and ground structures 324 that may be used with the electrical connector 304 (FIG. 9). The signal conductors 322 are elongated signal conductors 322. The ground structures 324 are also elongated ground conductors 324. In some embodiments, the signal conductors 322 and the ground conductors 324 have identical shapes such that either conductor can be used to transmit data signals and either conductor can be used as a ground structure. The ground conductors 324 and the signal conductors 322 may have similar or identical cross-sections. The signal and ground conductors 322, 324 are positioned within the receiving cavity 318 (FIG. 9) for engaging contact pads of a circuit board.

In FIG. 10, the ground conductors 324 and the signal conductors 322 are coplanar and form a portion of a row of conductors. The signal conductors 322 are arranged in signal pairs 325 with one or more ground conductors 324 disposed between adjacent signal pairs 325. Optionally, the electrical connector 304 may include another row of conductors.

The connector body 310 may be molded with a dielectric material. As shown, the connector body 310 may be shaped to include resonance-control surfaces 330 that include alternating proximal areas 332 and distal areas 334. The proximal areas 332 and distal areas 334 form recesses 340. The recesses 340 are coplanar with edges of the signal and ground conductors 322, 324. As described above with respect to the resonance-control surfaces 200 (FIG. 6), the alternating proximal areas 332 and distal areas 334 are designed to cause reflections within surface waves of electrical energy that propagates along the ground conductors 324.

It should be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector comprising:

a connector body having a front side configured to engage a first electrical component and a mounting side configured to engage a second electrical component;

a plurality of signal conductors extending through the connector body, the signal conductors including mating interfaces and mounting interfaces that are positioned for engaging the first and second electrical components, respectively, wherein the signal conductors follow a signal path between the respective mating and mounting interfaces; and a ground structure extending generally parallel to and between two of the signal conductors, wherein the connector body has a resonance-control surface that faces the ground structure, the resonance-control surface being shaped to include alternating distal and proximal areas, the proximal areas being closer to the ground structure than the distal areas, wherein the distal and proximal areas alternate along the signal path to form recesses in which the recesses are positioned in series along the signal path.

2. The electrical connector of claim 1, wherein at least two of the signal conductors extend parallel to one another and an axis, the recesses having a width and a length that is greater than the width, wherein the recesses extend lengthwise across the at least two signal conductors in a direction that is perpendicular to the axis.

3. The electrical connector of claim 1, wherein the signal conductors form at least four signal pairs configured for differential signal transmission and the ground structure includes a plurality of ground shields, each of the ground shields being positioned between at least two of the signal pairs, at least two of the signal pairs being positioned between adjacent ground shields, the mating interfaces of the signal conductors forming a two-dimensional array for engaging the first electrical component at the front side.

4. The electrical connector of claim 1, wherein the electrical connector is a pluggable input/output (I/O) connector in which the ground structure and the signal conductors are elongated conductors.

5. The electrical connector of claim 1, wherein the alternating distal and proximal areas dampen electrical resonance by causing reflections within surface waves of electrical energy that propagates along the ground structure, wherein the resonance-control surface, including the distal areas and the proximal areas, extends between the ground structure and at least some of the signal conductors.

6. The electrical connector of claim 1, wherein the signal conductors form a plurality of signal pairs configured for differential signal transmission.

7. The electrical connector of claim 1, wherein the connector body includes a molded dielectric body having the resonance-control surface.

8. The electrical connector of claim 7, wherein the ground structure is a ground shield having a broad side that faces the distal and proximal areas of the resonance-control surface, wherein a gap exists between the broad side and the proximal areas of the resonance-control surface.

9. The electrical connector of claim 7, wherein the ground structure is a ground shield having a broad side, wherein the broad side abuts the proximal areas and covers openings to the recesses.

10. The electrical connector of claim 7, wherein the ground structure is an elongated ground conductor and is coplanar with the signal conductors.

11. An electrical connector comprising:

a connector body having a front side configured to engage a first electrical component and a mounting side configured to engage a second electrical component, the connector body including a plurality of dielectric sections;

a plurality of signal conductors extending through or along respective dielectric sections, the signal conductors including mating interfaces and mounting interfaces that are positioned for engaging the first and second electrical components, respectively, the signal conductors forming signal pairs in which the signal conductors of each signal pair extend parallel to one another along a signal path between the front and mounting sides; and a plurality of ground shields in which each ground shield is interleaved between adjacent dielectric sections of the plurality of dielectric sections, wherein each of the dielectric sections has a resonance-control surface extending along a broad side of one of the ground shields, the resonance-control surface being shaped to include alternating distal and proximal areas that face the broad side, the proximal areas being closer to the broad side than the distal areas, wherein the distal and proximal areas alternate along at least one of the signal paths to form recesses of the dielectric section in which the recesses are positioned in series along the at least one signal path.

12. The electrical connector of claim 11, wherein the ground shields are shaped to attach to corresponding dielectric sections of the plurality of dielectric sections to form contact modules, the contact modules being stacked side-by-side.

13. The electrical connector of claim 11, wherein each of the dielectric sections includes a plurality of the resonance-control surfaces, the proximal areas and the distal areas of each of the dielectric sections forming a plurality of the recesses that are covered by the same ground shield of the plurality of ground shields.

14. The electrical connector of claim 11, wherein at least two of the signal pairs extend parallel to one another and an axis, the recesses having a width and a length that is greater than the width, wherein at least one of the recesses extends lengthwise across the at least two signal pairs in a direction that is perpendicular to the axis.

15. The electrical connector of claim 11, wherein the plurality of ground shields includes a first ground shield and a second ground shield, wherein the plurality of dielectric sections includes a designated dielectric section that is positioned between the first ground shield and the second ground shield, the series of recesses of the designated dielectric section opening only toward the first ground shield, wherein one of the signal pairs extends through the designated dielectric section parallel to the first and second ground shields, the signal pair being closer to the second ground shield than the first ground shield.

16. The electrical connector of claim 11, wherein the mating interfaces of the signal conductors are arranged in a high-density two-dimensional array for engaging the first electrical component, the electrical connector being designed for backplane or midplane communication systems and designed to operate at data rates greater than 10 gigabits/second (Gbps).

17. The electrical connector of claim 16, wherein the alternating distal and proximal areas dampen electrical resonance by causing reflections within surface waves of electrical energy that propagates along the broad side.

18. An electrical connector comprising:

a connector body having a front side configured to engage a first electrical component and a mounting side configured to engage a second electrical component, the connector body including a plurality of dielectric sections;

a plurality of signal conductors extending through or along respective dielectric sections, the signal conductors including mating interfaces and mounting interfaces that are positioned for engaging the first and second electrical components, respectively, the signal conductors forming signal pairs in which the signal conductors of each signal pair extend parallel to one another along a signal path between the front and mounting sides; and a plurality of ground shields interleaved between adjacent dielectric sections, a plurality of the signal pairs being positioned between adjacent ground shields, wherein each of the dielectric sections has a section side that abuts a broad side of a respective ground shield of the plurality of ground shields, the section side being shaped to include a plurality of recesses that open to the broad side, wherein the recesses are positioned in series along at least one of the signal paths to impede development of electrical resonance.

19. The electrical connector of claim 18, wherein the signal conductors form at least ten signal pairs, each of the ground shields being positioned between at least two of the signal pairs, at least two of the signal pairs being positioned between adjacent ground shields, the mating interfaces of the signal conductors forming a high-density two-dimensional array for engaging the first electrical component, wherein the resonance-control surfaces dampen electrical noise generated by one ground shield and reduce coupling of the electrical noise with a ground shield that is adjacent to the one ground shield.

20. The electrical connector of claim 19, wherein the electrical connector is designed to operate at data rates greater than 10 gigabits/second (Gbps), the recesses causing reflections within surface waves of electrical energy that propagates along the ground shields, wherein each of the dielectric sections has a thickness extending between the section side that abuts the broad side and an opposite section side, the resonance-control surfaces existing along only the section side that abuts the broad side and not the opposite section side.

* * * * *